US007869992B2

(12) United States Patent
Raifel et al.

(10) Patent No.: US 7,869,992 B2
(45) Date of Patent: Jan. 11, 2011

(54) METHOD AND APPARATUS FOR USING A WAVEFORM SEGMENT IN PLACE OF A MISSING PORTION OF AN AUDIO WAVEFORM

(75) Inventors: Mark Raifel, Ra'anana (IL); Guy Shterlich, Yad-Natan (IL); Yakov Chen, Rishon Letzion (IL)

(73) Assignee: AudioCodes Ltd., Lod (IL)

( * ) Notice: Subject to any disclaimer, the term of this patent is extended or adjusted under 35 U.S.C. 154(b) by 866 days.

(21) Appl. No.: 11/802,646

(22) Filed: May 24, 2007

(65) Prior Publication Data

US 2008/0294428 A1 Nov. 27, 2008

(51) Int. Cl.
*G10L 19/04* (2006.01)

(52) U.S. Cl. ..... 704/219

(58) Field of Classification Search ..... 704/219
See application file for complete search history.

(56) References Cited

PUBLICATIONS

"Packet Loss Concealment for Voice Transmission over IP Networks", Ejaz Mahfuz, Department of Electrical Engineering, McGill University, Montreal, Canada Sep. 2001 (www-mmsp ece.mcgill ca/MMSP/Theses/2001/MahfuzT2001 pdf ).

"A Survery of Packet Loss Recovery Techniques for Streaming Audio", C Perkins, O. Hodson, V Hardman, University College London, IEEE Network, Sep./Oct. 1998, pp. 40-48.

"Packet Loss Concealment for use with ITU-T Recommendation G 711- T1 521a-2000": ANSI-American National Standard-Committee T1 Telecommunications-, Supplement to T1 521-1999, prepared by T1A1, Technical Subcommittee on Performance and Signal Processing.

"Packet Loss Concealment for use with ITU-T Recommendation G 711- T1 521 T1 521-1999", ANSI-American National Standard-Committee T1 Telecommunications, Dec. 1999.

Series G: Transmission Systems and Media, Digital Systems and Networks: Digital transmission systems—Terminal equipments—Coding of analogue signals by pulse code modulation Pulse code modulation (PCM) of voice frequencies Appendix I: "A high quality low-complexity algorithm for packet loss concealment with G 711", ITU-T Recommendation G 711—Appendix I International Telecommunications Union (ITU-T), 1999.

*Algorithms for Sound and Music Computing*: Chapter 2, "Sound modeling: signal based approaches" by Giovanni De Poli and Federico Avanzini, 2 1-2 62; 2006.

*Primary Examiner*—Susan McFadden
(74) *Attorney, Agent, or Firm*—Eitan Mehulal Law Group

(57) ABSTRACT

A method for using a waveform segment in place of a missing portion of an audio waveform generated in response to a packet stream encoding portions of the audio waveform, the method comprising: phase matching a trailing portion of the waveform segment with a trailing portion of the audio waveform that follows the missing portion; and adding the phase matched waveform segment to the audio waveform.

20 Claims, 4 Drawing Sheets

METHOD AND APPARATUS FOR USING A WAVEFORM SEGMENT IN PLACE OF A MISSING PORTION OF AN AUDIO WAVEFORM

FIELD

The invention relates to audio transmission over packet switched networks.

BACKGROUND

A packet switched network is a communication network that transmits data from a sender to a receiver packaged in packets, which are routed from the sender to the receiver over a network of switching nodes connected by "data links". Each switching node receives packets via links that connect it to other switching nodes and switches packets that it receives to forward them over other data links that are suitable for bringing the packets to their destinations. Any two given packets may propagate over different routes, i e. different configurations of nodes and links, from a same sender to a same receiver. Examples of such packet switched networks are Arpanet, which was established more than thirty years ago and is the first packet switched network, and the Internet. The Internet is used today for all types of data communication and is commonly used to transmit multimedia data and for voice communication, conventionally known as Voice over Internet Protocol (VoIP).

A packet comprises a header at the beginning of the packet, a payload in the middle of the packet, and a trailer at the end of the packet. The header generally includes information related to a destination address of the packet, routing information, a sequence number that identifies the packet's position in a transmitted sequence of packets, and information regarding a size of the packet The payload comprises data actually being communicated. The trailer typically includes error-checking data, which is used at the packet's destination to detect errors, which may have occurred in the packet on route.

Since packets from a same sender to a same receiver may travel via different routes, packets, which are sequentially transmitted, may arrive at their common destination, i.e. receiver, in a different order than the order in which they were transmitted. As each packet is identified by a sequence number, its processing at the receiver will be done according to the sequence number regardless of the order in which it arrived at the receiver.

In VoIP and other voice related packet switching applications, a sender's transmitter will generally digitize an analog voice stream and group the resultant digital data in sections. The transmitter packages each section in a payload portion of a packet and sends the packet to a receiver, or a plurality of receivers, via the Internet. The receiver decodes the data in the payloads of the packets it receives and orders the data according to the sequence numbers of the packets to regenerate the voice stream. In VoIP protocols, generally, packets are required to be received at the receiver within a delay time less than from about 250 msec to about 500 msec following their transmission in order to maintain voice continuity of a reconstructed voice stream. The network generally classifies packets that do not reach their destinations within this delay as "lost packets", ceases attempts at routing them to their destinations and discards them. Packet losses may affect intelligibility of a received voice stream if sound encoded in lost packets has a generally continuous duration, hereinafter a "discontinuity duration", between about 60 msec to about 100 msec. To make up for the lost packets, packet loss concealment (PLC) techniques are commonly used in VoIP and other voice related packet switching applications. PLC techniques are generally considered to be either sender based or receiver based.

Sender based techniques may be classified as "active" or "passive". Active techniques generally involve the receiver sending a message to the sender informing the sender which packets are lost, in response to which, the sender retransmits the lost packets. A drawback of this technique is that often a period, from a moment when a "lost packet" in a voice stream is first transmitted until a replacement packet is received at the receiver, exceeds the 250-500 msec delay time required to maintain voice continuity of the voice stream.

There are generally considered to be two types of passive techniques: interleaving and forward error correction. In interleaving, the transmitter distributes bytes that encode temporally contiguous portions of an audio stream in different packets prior to transmission. As a result, loss of a single packet does not, in general, result in loss of audio data corresponding to a continuous period of time greater than that corresponding to audio data encoded in a single byte, which is generally less than the discontinuity duration. Forward error correction comprises sending additional data with each packet, often referred to as redundancy data, that is useable to reconstruct lost packets. Reed Solomon encoding/decoding is a well-known forward error correction technique. Passive methods usually require that all data in a given data stream be received prior to processing and reconstructing lost packets. As a result, these techniques may be time consuming and may requite large buffering capacity in the receiver.

Receiver based techniques generally take advantage of a characteristic whereby variations in an audio waveform of a voice signal are relatively very small between adjacent packets. Numerous receiver-based techniques are known in the art, some of which are briefly discussed below.

a. Silence Substitution—the method comprises replacing voice that is encoded in a lost packet with a period of silence.
b. Packet Repetition—the method comprises replacing a lost packet with a duplicate of a packet immediately preceding the lost packet.
c. Pitch Estimation—the method comprises determining a fundamental frequency of voice encoded in packets preceding a lost packet and duplicating the fundamental frequency during a period in which voice encoded in the missing packet would be made audible.
d. Linear Prediction—the method comprises determining waveform parameters from a portion of an audio waveform preceding a segment of the waveform encoded in a lost packet. The lost segment is synthesized responsive to the predicted parameters using linear interpolation techniques. Optionally, a portion of the audio waveform following the lost segment may also be used to perform linear prediction.

For convenience of presentation, a portion of an audio waveform encoded in a packet immediately preceding a lost packet is referred to as a "leading portion". A portion encoded in a packet immediately following the lost packet is referred to as a "trailing portion".

Typically, in replacing a missing portion of an audio waveform with a synthesized segment, the synthesized segment is matched to the leading portion of the audio waveform to provide a smooth transition between the leading portion and the synthesized segment. Generally, matching comprises overlapping and adding (OLA) a leading section of the synthesized segment with a trailing section of the leading portion so that the amplitude of the audio waveform is substantially preserved in a leading overlap region. In other matching techniques the trailing section of the leading portion is butted on to the leading section of the synthesized segment. Furthermore, several other matching techniques comprise phase matching, referred to as "synchronous overlap and add" (SOLA) techniques, wherein the leading section of a synthesized segment is overlapped with a trailing section of a leading portion of the waveform to preserve pitch as well as amplitude in the overlap region.

PLC and techniques for synthesizing lost packets may be found in "Packet Loss Concealment for Voice Transmission over IP Networks", Ejaz Mahfuz, Department of Electrical Engineering, McGill University, Montreal, Canada. September 2001, (www.tsp.ece.mcgill.ca/MMSP/Theses/2001/MahfuzT2001.pdf), "A Survey of Packet Loss Recovery Techniques for Streaming Audio", C. Perkins, O. Hodson, V. Hardman, IEEE Network, September/October 1998, pp. 40-48, ANSI T1.521a-2000 (Annex B) "Standard for Packet Loss Concealment", and ITU-T Recommendation G.711, Appendix I, "A High Quality Low-Complexity Algorithm for Packet Loss Concealment with G.711", all of which are incorporated herein by reference. OLA and SOLA techniques are described in Chapter 2, "Sound modeling: signal based approaches" by Giovanni De Poli and Federico Avanzini (www.dei.unipd.it/~musical/IM06/Dispense06/2_signalmodels.pdf), incorporated herein by reference.

SUMMARY OF THE DISCLOSURE

An aspect of some embodiments of the invention relates to providing a method and apparatus for synchronizing a synthesized waveform segment that is used in place of a missing portion of an audio waveform generated in response to a packet stream encoding portions of the audio waveform.

According to an aspect of an embodiment of the invention, the synthesized waveform segment is synchronized with a leading portion of the audio waveform that precedes the missing portion and with a trailing portion of the audio waveform that follows the missing portion.

In an embodiment of the invention, synchronizing the synthesized waveform segment with the trailing portion of the audio waveform comprises overlapping the trailing section of the synthesized segment with the leading section of the trailing portion and phase matching the synthesized segment with the trailing portion so that a fundamental frequency, i.e. "pitch", as well as amplitude of the audio waveform, is substantially preserved in a trailing overlap region. Synchronizing the segment with the leading portion optionally comprises phase matching the synthesized segment with the leading portion of the audio waveform and optionally overlapping the leading section of the synthesized segment with the trailing section of the leading portion.

Prior art techniques for replacing a lost segment with a synthesized segment generally provide for synchronous overlapping and addition of a leading section (SOLA) of the synthesized segment with a trailing section of the leading portion of an audio waveform. The rear section of the synthesized segment and leading section of the trailing portion of the audio waveform are weighted to provide relative continuity of amplitude. However, the synthesized segment and the trailing portion are not synchronized to provide continuity of pitch or phase. The rear section of the synthesized segment is allowed to "fall where it may", presumably under an assumption that the rear section of the synthesized segment is properly synchronized to the trailing portion of the audio stream if the leading section of the segment is properly synchronized to the leading portion of the audio stream. The inventors have found however, that often in prior art replacement techniques, the rear section of a synthesized segment is not appropriately synchronized with a trailing portion of an audio waveform and that the lack of synchrony can cause noticeable degradation in quality of an audio stream generated responsive to the waveform. Synchronizing the rear section of the synthesized segment and the audio waveform, independent of synchronizing the leading section of the segment and waveform, in accordance with an embodiment of the invention, can result in noticeable improvement in the quality of the audio stream.

In accordance with an embodiment of the invention, synchronizing the rear section of the synthesized segment with the trailing portion of the audio waveform comprises temporally displacing the trailing portion of the waveform relative to the segment after the segment is synchronized with the leading portion. Optionally, synchronizing the synthesized segment with the leading portion comprises temporally displacing the segment relative to the leading portion to provide a phase match with the leading portion.

There is therefore provided, in accordance with an embodiment of the invention, a method for using a waveform segment in place of a missing portion of an audio waveform generated in response to a packet stream encoding portions of the audio waveform, the method comprising: phase matching a trailing portion of the waveform segment with a trailing portion of the audio waveform that follows the missing portion; and adding the phase matched waveform segment to the audio waveform. Optionally, phase matching the trailing portions comprises temporally displacing the trailing portion of the audio waveform. Additionally or alternatively, the method optionally provides for phase matching a leading portion of the waveform segment with a leading portion of the audio waveform that precedes the missing portion.

Furthermore, in accordance with some embodiments of the invention, the method provides for overlapping the leading portions to generate a leading overlap waveform region. Optionally, the amplitudes of the overlapping leading portions are modulated so that the amplitude of the leading overlap waveform region is substantially the same as that of the leading portion of the audio waveform.

In some embodiments of the invention, the method optionally further comprises overlapping the trailing portion to generate a trailing overlap waveform region. Optionally, the amplitudes of the overlapping trailing portions are modulated so that the amplitude of the trailing overlap waveform region is substantially the same as that of the leading portion of the audio waveform.

There is further provided, in accordance with an embodiment of the invention, a receiver for receiving a packet stream encoding portions of an audio waveform, the receiver comprising: a generator that generates a waveform segment suitable for replacing a missing portion of the audio waveform; and circuitry adapted to phase match a trailing portion of the waveform segment with a trailing portion of the audio waveform that follows the missing portion. Optionally, the receiver includes circuitry comprising an overlap and add unit that overlaps and adds the trailing portion of the waveform segment with the trailing portion of the audio waveform.

There is further provided in accordance with an embodiment of the invention, a computer readable medium containing a set of instructions for programming a processor to use a waveform segment to replace a missing portion of an audio waveform generated in response to a packet stream encoding portions of the audio waveform, the instructions comprising: a routine for phase matching a trailing portion of the waveform segment with a trailing portion of the audio waveform that follows the missing portion; and a routine for adding the phase matched waveform segment to the audio waveform.

There is further provided in accordance with an embodiment of the invention, a signal set encoded with a set of instructions for programming a processor to use a waveform segment to replace a missing portion of an audio waveform generated in response to a packet stream encoding portions of the audio waveform, the instructions comprising: instructions for phase matching a trailing portion of the waveform segment with a trailing portion of the audio waveform that follows the missing portion; and instructions for adding the phase matched waveform segment to the audio waveform.

BRIEF DESCRIPTION OF FIGURES

Examples illustrative of embodiments of the invention are described below with reference to figures attached hereto. In the figures, identical structures, elements or parts that appear in more than one figure are generally labeled with a same numeral in all the figures in which they appear. Dimensions of components and features shown in the figures are generally chosen for convenience and clarity of presentation and are not necessarily shown to scale. The figures are listed below.

DETAILED DESCRIPTION

Figure 1:
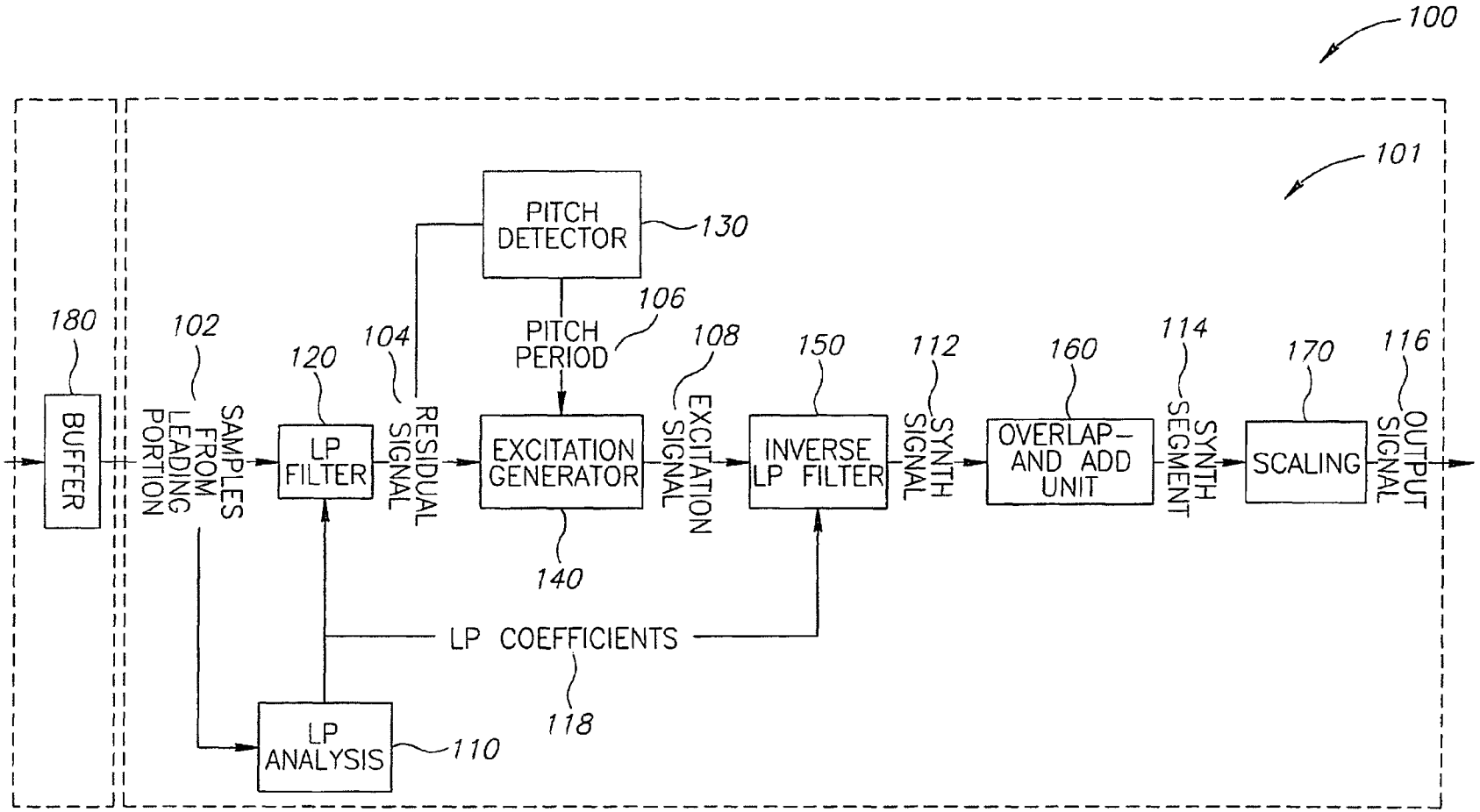
FIG.1 PRIOR ART
FIG. 1 schematically shows an exemplary functional block diagram of a linear prediction (LP) based PLC module in accordance with prior art.

Reference is made to FIG. 1, which schematically shows an exemplary functional block diagram of a linear prediction (LP) based packet loss concealment (PLC) module 101 known in the art comprised in a receiver 100. PLC module 101 uses a linear prediction technique to synthesize an audio waveform segment optionally based on a leading portion of the audio waveform. Incoming packets to the receiver are processed such that a last received packet is temporarily stored in a buffer for possible use in PLC applications should an immediately following packet not arrive.

In a typical PLC application a leading portion 102 associated with the last received packet, or a plurality of last received packets, stored in a buffer 180, is input to LP filter 120. LP filter 120 comprises a finite impulse response (FIR) filter with frequency response characteristics determined by LP coefficients 118, which are generated by a LP analysis circuitry 110. Responsive to the LP coefficients LP filter 120 produces a residual signal 104 characterized by the fundamental frequency and amplitude of leading portion 102. Generation of the LP coefficients in LP analysis circuitry 120 comprises windowing a section of the leading portion followed by computing an autocorrelation or alternatively, a covariance, of the windowed section. The LP coefficients are selected so that the energy level of residual signal 104 is substantially minimized.

Residual signal 104 is fed into a Pitch Detector 130 and an Excitation Generator 140. Pitch Detector 130 is adapted to estimate a pitch period of leading portion 102 by searching for peak locations, hereinafter referred to as "pitch peaks", in the normalized autocorrelation function of residual signal 104, or alternatively, in the normalized covariant function of the residual signal. Once the pitch period of leading portion 102 is estimated, Excitation Generator 140 may generate an excitation signal 108 responsive to the input of pitch period 106 from Pitch Detector 130 and the input of residual signal 104. Excitation signal 108 comprises a portion of residual signal 104 a pitch period in length, replicated throughout substantially the entire length of the excitation signal. The entire length of excitation signal 108 is usually greater than that of the missing waveform.

Inverse LP Filter 150 comprises an inverse FIR filter with frequency response characteristics determined by LP coefficients 118 and is adapted to add into Excitation signal 108 the frequency spectrum characteristics of the leading portion of the audio waveform. Inverse LP Filter 150 outputs a synthesized signal 112 comprising a synthesized segment of the audio waveform with a frequency spectrum and pitch period similar to leading portion 102. Synthesized signal 112 is of a greater length than the missing portion of the audio waveform, the additional length used to optionally overlap-and-add with a trailing section of a leading portion of the audio waveform and to overlap and add with a leading section of a trailing portion of the audio waveform.

An Overlap-and-Add (OLA) circuitry 160 is used to attach synthesized signal 112 onto the leading portion and the trailing portion. A window is used for phase matching the trailing section of the leading portion with a leading section of the synthesized signal. Optionally, in some embodiments of the invention the window is used for weighting and summing the trailing section of the leading portion with the leading section of the synthesized signal. OLA circuitry 160 comprises a buffer in which a rear section of synthesized signal 112 is stored. A window is also used for weighting and summing the rear section of synthesized signal 112 with the leading section of the trailing portion. The windowed section of synthesized signal 112 which comprises the missing portion in the audio waveform is referred to as a synthesized segment 114.

A scaling circuitry 170 is adapted to adjust the volume of synthesized segment 114 before being output as an output signal 116 to a loudspeaker (not shown). This is generally done to limit the effects of unwanted variations which may occur in the waveform of relatively long synthesized segments (usually exceeding 10 msec). As synthesized signal 114 passes through scaling circuitry 170 the amplitude of a section of the signal presently in the scaling circuitry is modified by a predefined "current" scaling value, which may vary up or down as a function of time.

Figure 2:
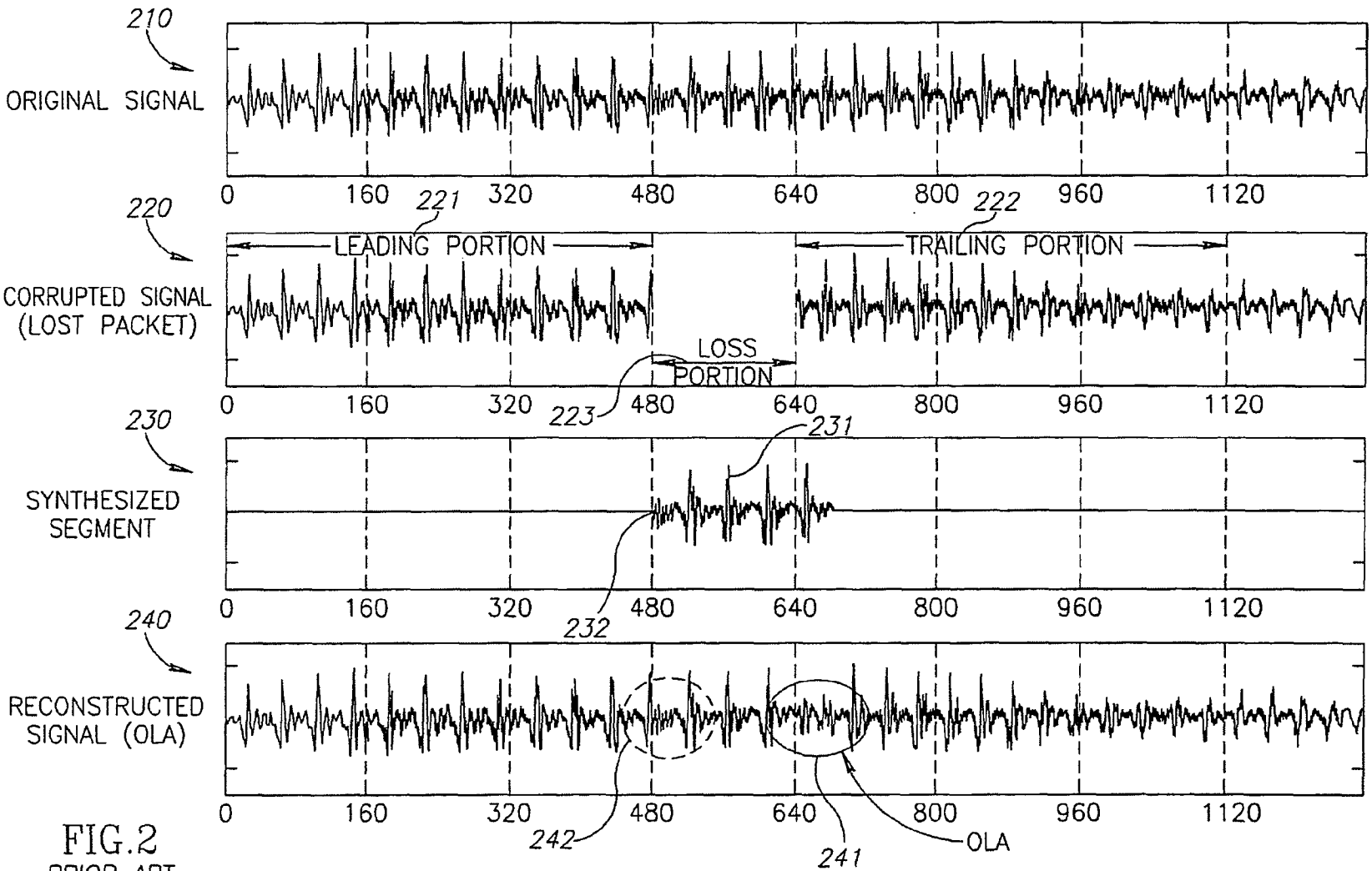
FIG. 2 PRIOR ART
FIG. 2 schematically illustrates synchronizing a waveform segment synthesized to replace a missing segment of an audio waveform with the audio waveform, in accordance with prior art.

Reference is made to FIG. 2, which schematically illustrates waveform diagrams for an exemplary synthesizing process known in the art by a generic PLC module adapted to perform OLA. The generic PLC module may be the same or similar to PLC module 101 shown in FIG. 1. In the waveform diagrams the abscissa is graduated in sample numbers, the audio waveform samples represented by higher sample numbers are "played" or "vocalized" later than samples having lower sample numbers.

An "original" signal 210 represents a section of an audio waveform prior to transmission through a packet switched network. Following routing through the network a packet, or several consecutive packets, is lost so that the signal at the receiving end is an exemplary corrupted signal 220. Corrupted signal 220 is characterized by a leading portion 221, which corresponds to the packet received immediately prior to the packet loss, a trailing portion 222 which corresponds to the packet received immediately following the packet loss, and a loss or missing portion 223 which corresponds to the lost packet and extends from sample 480 to 640.

In a synthesizing process by the generic PLC module (FIG. 1) adapted to perform OLA, an exemplary synthesized segment 230 is synthesized to replace the lost packet. Synthesized segment 230 extends from sample 480 to approximately 680 and is longer than the loss portion 223. Synthesized segment 230 is a copy of approximately 200 samples from the trailing section of leading portion 221 and comprises a leading edge 232, four pitch peaks, such as that shown at pitch peak 231, with the same fundamental frequency as in leading portion 221. Leading edge 232 is adapted to match in phase with the trailing edge of leading portion 221 to which synthesized segment 230 will be attached.

Application of OLA synthesis and the resulting audio waveform is shown by an exemplary reconstructed signal 240. A leading section 242 of synthesized segment 230 is added to the trailing end of leading portion 221. Possible discontinuity at the transition between leading portion 221 and synthesized segment 230 is minimized by phase matching at the edges. A rear section 241 of synthesized segment 230 is added to the leading section of trailing portion 222 using OLA windowing. A discontinuity in the transition between synthesized signal 230 and trailing portion 222 at rear section 241 is evidenced by the increase in the separation between two pitch peaks in the neighborhood of sample 640. The increase in the separation represents a variation in the fundamental frequency of reconstructed signal 240 in that section of the audio waveform, resulting in degradation of quality of sound generated responsive to the waveform.

Figure 3:
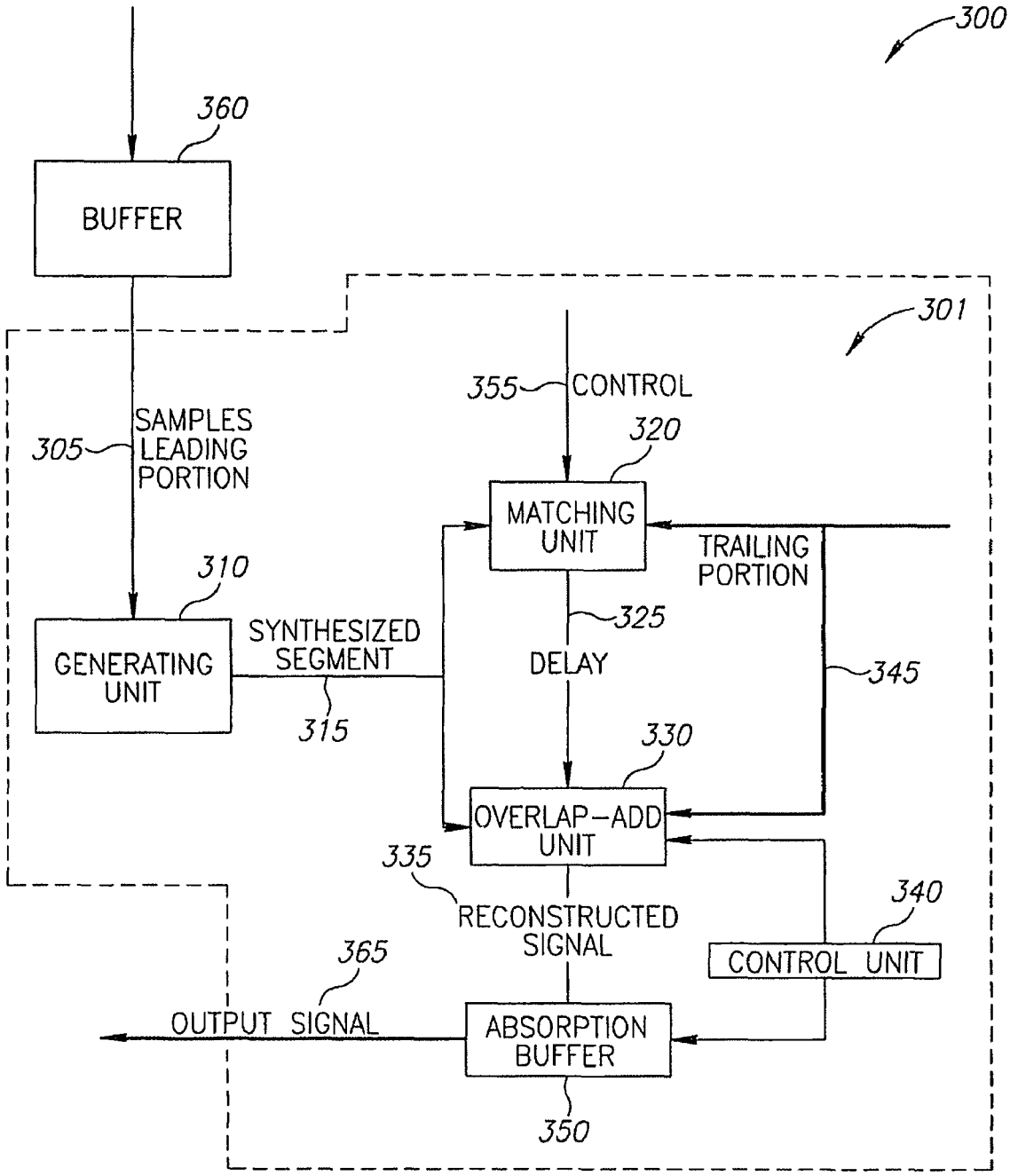
FIG. 3 schematically shows an exemplary functional block diagram of an improved PLC module in a receiver, in accordance with an embodiment of the invention.

Reference is made to FIG. 3, which schematically shows an exemplary functional block diagram of an improved PLC module 301 in a receiver 300, in accordance with an embodiment of the invention, Improved PLC module 300 is adapted to synthesize an audio waveform segment, and to reconstruct an audio waveform in which synchronization is maintained in the transition between a leading portion of the audio waveform and the synthesized segment, and between the synthesized segment and a trailing portion of the audio waveform. The result is that the fundamental frequency of the audio waveform is substantially preserved preventing voice degradation.

Improved PLC module 301 comprises a Generating Unit 310, a Matching Unit 320, an Overlap-Add Unit 330, a Control Unit 340, an Absorption Buffer 350, and a Buffer 360. In accordance with an embodiment of the invention, Generating Unit 310 is adapted to synthesize, using any method known in the art, an audio waveform segment 315, also referred to as "synthesized signal", using samples from a leading portion 305 of an audio waveform associated with a last packet, or a plurality of last received packets, arriving at a receiver 300. Samples of leading portion 305 are continuously stored in a Buffer 360 irrespective of whether there is packet loss or not. The samples are stored in case the next packet does not arrive. If the packet arrives, the stored samples, or portion of stored samples, are replaced by samples from the newly arrived packet. In some embodiments of the invention, Generating Unit 310 may use samples stored in a buffer from leading portion 305 and a trailing portion 345 of the audio waveform, while in other embodiments of the invention, Generating Unit 310 may use samples stored in a buffer from trailing portion 345 of the audio waveform. Synthesized signal 315, which may be similar or the same as synthesized signal 112 in FIG. 1, is generated by Generating Unit 310 only in response to a packet loss. In other embodiments of the invention, synthesized signal 315 may be generated continuously whether or not there is a packet loss.

Matching Unit 320 is adapted to estimate a temporal shift in trailing portion 345 so that the pitch peaks in trailing portion 345 will be synchronized with the pitch peaks of synthesized signal 315. Synchronization is performed by buffering and shifting forward or backward trailing portion 345 with respect to synthesized signal 315 until one or more of their pitch peaks are temporally matched. Shift estimation is performed optionally using cross-correlation techniques known in the art, such as, for example Maximum Correlation. When a packet, or several consecutive packets, is determined to be missing, Matching Unit 320, in response to a control signal 355 from Control Unit 340, outputs a delay signal 325. Delay signal 325 is input to OLA Unit 330 and comprises information related to the estimated temporal shift, forward or backward, required in trailing portion 345 during the OLA windowing process so that the pitch peaks overlap.

OLA Unit 330 is used to attach synthesized signal 315 onto trailing portion 345. A window is used for phase matching a trailing section of leading portion 305 with a leading section of synthesized signal 315. A resulting reconstructed signal 335 is then buffered in Absorption Buffer 350. In accordance with some embodiments of the invention, OLA Unit 330 may be comprised in Generating Unit 310. Leading portion 305 is continuously buffered also in Absorption Buffer 350, irrespective of whether there is packet loss or not. Absorption Buffer 350 outputs an output signal 365 to a loudspeaker (not shown) comprising the leading portion and the reconstructed signal. If there is no packet loss the output signal comprises only the leading portion. Synchronization between the leading portion and the reconstructed signal is maintained by Control Unit 340. Control Unit 340 also maintains synchronization in the absorption buffer between the leading portion and the reconstructed signal, relative to subsequently arriving trailing portions due to the temporal shifting, forward or backward, of the trailing portion. In some embodiments of the invention, Absorption Buffer 350 may comprise Buffer 360. By temporally shifting forward (shifting forward in time) the trailing portion is output earlier in the audio stream than if there had there not been any packet loss. By temporally shifting backward the trailing portion it is output later in the audio stream than if there had not been any packet loss.

Optionally, in some embodiments of the invention, the window is used for weighting and summing a trailing section of the leading portion with a leading section of the synthesized signal. A window is also used for weighting and summing a rear section of synthesized signal 315 with a leading section of trailing portion 345. Reconstructed signal 335 is then also stored in Absorption Buffer 350 and subsequently output as part of output signal 365. Control Unit 340 is adapted to manage the synchronization of the functions performed by Matching Unit 320, OLA Unit 330, and Absorption Buffer 350.

Figure 4:
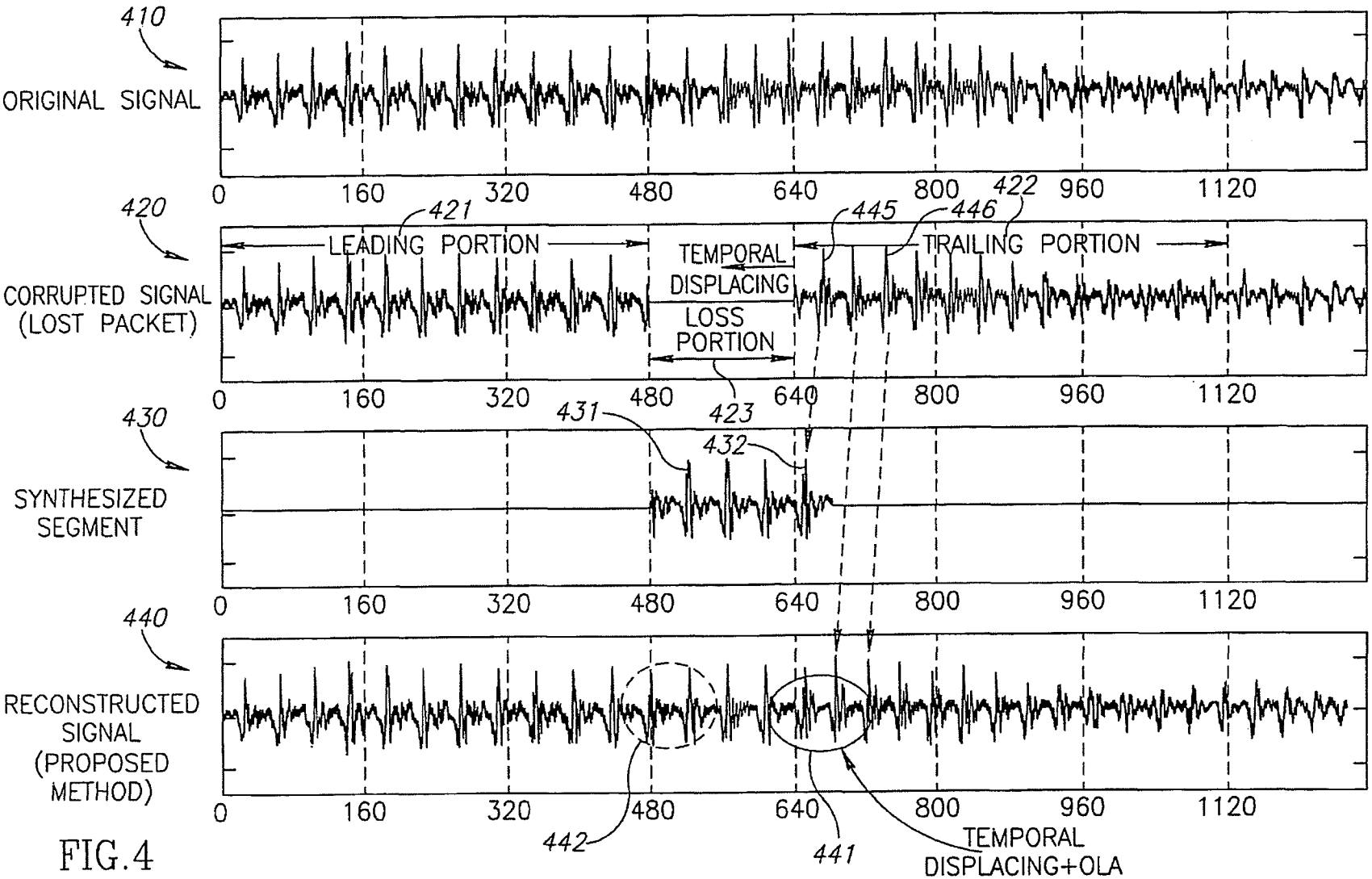
FIG. 4 schematically illustrates synchronizing a waveform segment synthesized to replace a missing segment of an audio waveform with the audio waveform, in accordance with an embodiment of the invention.

Reference is made to FIG. 4 which schematically illustrates waveform diagrams for an exemplary synthesizing process by an improved PLC module in accordance with an embodiment of the invention.

Improved PLC module may be similar or the same as improved PLC module 301 in FIG. 3. An original signal 410 represents a section of an exemplary audio waveform prior to transmission through a packet switched network. Following routing through the network, a packet, or several consecutive packets, is lost so that the signal at the receiving end is the exemplary corrupted signal 420. Corrupted signal 420 is characterized by a leading portion 421 which corresponds to the packet received immediately prior to the packet loss, a trailing portion 422 which corresponds to the packet received immediately following the packet loss, and a loss or missing portion 423 which corresponds to the lost packet and extends from sample 480 to 640. No information is available on that portion of original signal 410 due to the packet loss.

In a synthesizing process by the improved PLC module, an exemplary synthesized segment 430 is synthesized to replace the lost packet. Synthesized segment 430 extends from sample 480 to approximately 680 and is longer than the loss portion 423. Synthesized segment 430 is a copy of approximately 200 samples from the trailing section of leading portion 421 and comprises four pitch peaks, such as that shown at pitch peak 431, with a same fundamental frequency as in leading portion 421. In accordance with some embodiments of the invention, synthesized segment 430 may be longer and/or may comprise a greater number of pitch peaks, for example the synthesized segment may have a length of 250 samples and extend from sample 480 to 730 and comprise 5 pitch peaks. Furthermore, in some other embodiments of the invention, synthesized segment 430 may be shorter and/or may comprise a lesser number of pitch peaks, for example, the synthesized segment may have a length of 160 samples and extend from sample 480 to 640 and comprise 3 pitch peaks.

Application of the matching process is shown for the audio waveform of exemplary corrupted signal 420. Trailing portion 422 is shifted forward in time so that a first peak 445 is matched with the last pitch peak 432 of synthesized segment 430, shifting forward by the same amount of time all other pitch peaks in trailing portion 422, such as for example pitch peak 446.

Application of OLA synthesis and the resulting audio waveform is shown by an exemplary reconstructed signal 440. A leading section 442 of synthesized segment 430 is added to the trailing section of leading portion 421 using phase matching, eliminating possible discontinuity at the transition between leading portion 421 and synthesized segment 430. A rear section 441 of synthesized segment 430 is added to the leading section of trailing portion 422 using OLA windowing. A discontinuity in the transition between synthesized signal 430 and trailing portion 422 at rear section 441 is prevented by matching the last pitch peak 432 with pitch peak 445 and backward shifting of trailing portion 422. Furthermore, the output audio quality is maintained as there in no substantial change in the fundamental frequency of reconstructed signal 440 compared to original signal 410.

In the description and claims of embodiments of the present invention, each of the words, "comprise" "include" and "have", and forms thereof, are not necessarily limited to members in a list with which the words may be associated.

The invention has been described using various detailed descriptions of embodiments thereof that are provided by way of example and are not intended to limit the scope of the invention. The described embodiments may comprise different features, not all of which are required in all embodiments of the invention. Some embodiments of the invention utilize only some of the features or possible combinations of the features. Variations of embodiments of the invention that are described and embodiments of the invention comprising different combinations of features noted in the described embodiments will occur to persons with skill in the art. The scope of the invention is limited only by the claims.

The invention claimed is:

1. A method for using a waveform segment in place of a missing portion of an audio waveform generated in response to a packet stream encoding portions of the audio waveform, the method comprising:

phase matching a trailing portion of the waveform segment with a trailing portion of the audio waveform that follows the missing portion; and adding the phase matched waveform segment to the audio waveform, wherein the method is to be performed by an electronic device.

2. The method according to claim 1 wherein phase matching the trailing portions comprises temporally displacing the trailing portion of the audio waveform.

3. The method according to claim 1 wherein the method comprises:

phase matching a leading portion of the waveform segment with a leading portion of the audio waveform that precedes the missing portion.

4. The method according to claim 1, comprising overlapping the leading portions to generate a leading overlap waveform region.

5. The method according to claim 4 and comprising modulating the amplitudes of the overlapping leading portions so that the amplitude of the leading overlap waveform region is substantially the same as that of the leading portion of the audio waveform.

6. The method according to claim 1, comprising overlapping the trailing portion to generate a trailing overlap waveform region.

7. The method according to claim 4 and comprising modulating the amplitudes of the overlapping trailing portions so that the amplitude of the trailing overlap waveform region is substantially the same as that of the leading portion of the audio waveform.

8. A receiver for receiving a packet stream encoding portions of an audio waveform, the receiver comprising:

a generator to generate a waveform segment suitable for replacing a missing portion of the audio waveform; and circuitry to phase match a trailing portion of the waveform segment with a trailing portion of the audio waveform that follows the missing portion.

9. The receiver according to claim 8 wherein the circuitry comprises an overlap and add unit that overlaps and adds the trailing portion of the waveform segment with the trailing portion of the audio waveform.

10. The receiver of claim 8, comprising:

circuitry to temporally displace the trailing portion of the audio waveform.

11. The receiver of claim 8, comprising:

circuitry to phase match a leading portion of the waveform segment with a leading portion of the audio waveform that precedes the missing portion.

12. The receiver of claim 8, comprising:

circuitry to overlap the leading portions to generate a leading overlap waveform region.

13. The receiver of claim 8, comprising:

circuitry to modulate the amplitudes of the overlapping leading portions so that the amplitude of the leading overlap waveform region is substantially the same as that of the leading portion of the audio waveform.

14. The receiver of claim 8, comprising:

circuitry to modulate the amplitudes of the overlapping trailing portions so that the amplitude of the trailing overlap waveform region is substantially the same as that of the leading portion of the audio waveform.

15. A computer readable non-transitory medium having stored thereon instructions that, when executed by a processor, cause the processor to perform a method for using a waveform segment to replace a missing portion of an audio waveform generated in response to a packet stream encoding portions of the audio waveform, wherein the method comprises:

phase matching a trailing portion of the waveform segment with a trailing portion of the audio waveform that follows the missing portion; and adding the phase matched waveform segment to the audio waveform.

16. The computer readable non-transitory medium according to claim 15 wherein phase matching the trailing portions comprises temporally displacing the trailing portion of the audio waveform.

17. The computer readable non-transitory medium according to claim 15 wherein the method comprises:

phase matching a leading portion of the waveform segment with a leading portion of the audio waveform that precedes the missing portion.

18. The computer readable non-transitory medium of claim 15, wherein the method comprises:

overlapping the leading portions to generate a leading overlap waveform region.

19. The computer readable non-transitory medium of claim 15, wherein the method comprises:

modulating the amplitudes of the overlapping leading portions so that the amplitude of the leading overlap waveform region is substantially the same as that of the leading portion of the audio waveform.

20. The computer readable non-transitory medium of claim 15, wherein the method comprises:

overlapping the trailing portion to generate a trailing overlap waveform region.

* * * * *